US005260916A

United States Patent [19]

Schott

[11] Patent Number: 5,260,916

[45] Date of Patent: Nov. 9, 1993

[54] TIMER

[75] Inventor: Bernard Schott, Saverne, France

[73] Assignee: Diehl Gmbh & Co., Nurnberg, Fed. Rep. of Germany

[21] Appl. No.: 964,124

[22] Filed: Oct. 20, 1992

Related U.S. Application Data

[63] Continuation of Ser. No. 687,202, Apr. 18, 1991, abandoned, which is a continuation of Ser. No. 497,410, Mar. 22, 1990, abandoned.

[30] Foreign Application Priority Data

Mar. 22, 1989 [FR] France ..... 89 03636

[51] Int. Cl.[5] ..... G04C 11/02; G04F 8/00

[52] U.S. Cl. ..... 368/47; 368/107; 307/141.4

[58] Field of Search ..... 368/47, 64, 66, 107-109, 368/250, 251; 307/141, 141.4; 340/309.15, 309.14; 364/483, 492, 569

[56] References Cited

U.S. PATENT DOCUMENTS

| | | | |
|---|---|---|---|
| 4,328,539 | 5/1982 | Heeger | 364/144 |
| 4,408,299 | 10/1983 | Young | 364/900 |
| 4,523,295 | 6/1985 | Zato | 364/900 |
| 4,680,706 | 7/1987 | Bray | 364/492 |
| 5,016,273 | 5/1991 | Hoff | 380/10 |

FOREIGN PATENT DOCUMENTS

| | | |
|---|---|---|
| 180155 | 7/1986 | European Pat. Off. . |
| 1921520 | 12/1970 | Fed. Rep. of Germany . |
| 3241533 | 10/1984 | Fed. Rep. of Germany . |

*Primary Examiner*—Vit W. Miska

*Attorney, Agent, or Firm*—Scully, Scott, Murphy & Presser

[57] ABSTRACT

A timer which is resistive or substantially impervious to an outage which is encountered in the main power supply voltage. The timer includes a non-volatile power storage for specifiable switching timepoints, and instead of a power storage-buffered or backed running reserve possesses only a resetting device for the actual timer time setting at the renewed availability of the main power supply.

5 Claims, 1 Drawing Sheet

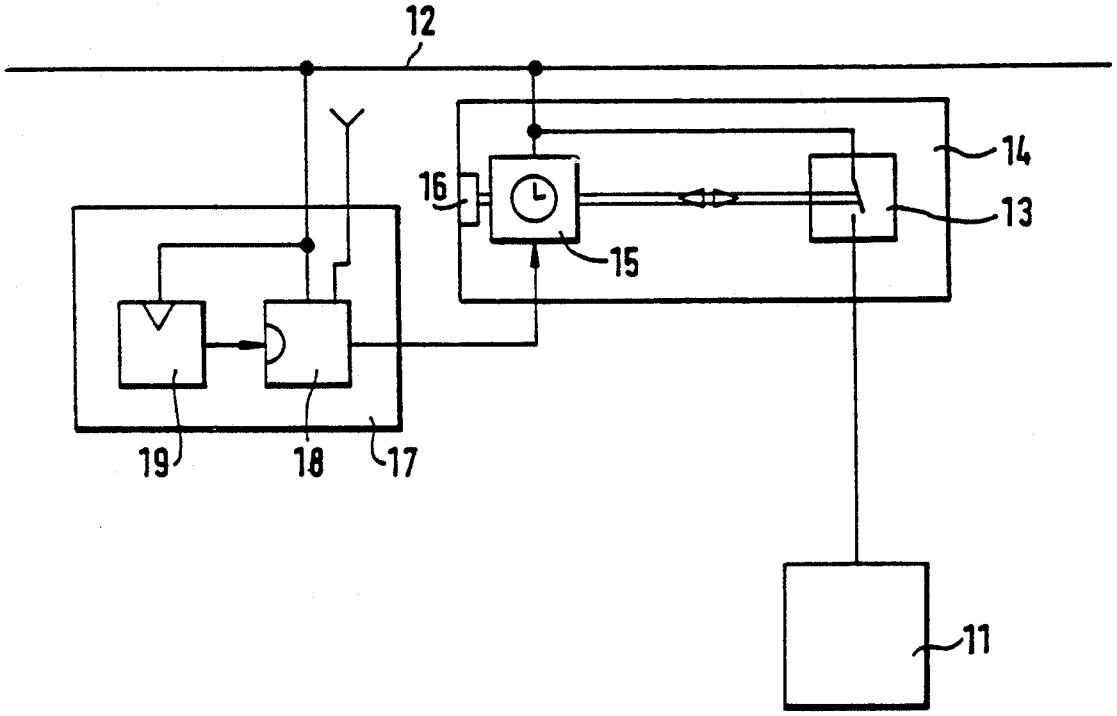
12
14
16
13
15
19
18
17
11

TIMER

This is a continuation of copending application Ser. No. 687,202 filed on Apr. 18, 1991 which is a continuation of application Ser. No. 497,410, filed on Mar. 22, 1990.

BACKGROUND OF THE INVENTION

1. Field of the Invention

The present invention relates to a timer which is resistive or substantially impervious to a power outage which is encountered in the main power supply.

As a rule, a timer of that type is usually equipped with a so-called running reserve for bridging over of transient outages of the main power supply, such that the timer will also continue to operate in a correct time cycle even during the outage or failure of the main power supply, and as a consequence, the normal operation under main power can again proceed upon renewed availability of the main power supply with requiring the setting of the timer to the actual real point in time. The running reserve generally comprises a primary or a secondary battery and a voltage-controlled switching device, The voltage-controlled switching device connects the timer to the main power supply during normal operation, and connects the timer to the secondary battery when the main power-supply voltage falls below a minimum value which is necessary for operation; in essence, especially when the power fails completely due to reasons of operating disruptions caused by the power supply.

2. Discussion of the Prior Art

A timer of this type which is battery-backed for the provision of a running reserve, but which is ordinarily operated from a main power supply, is generally known in the timing control art. Through the operational buffering or support from the built-in running reserve there is ensured that upon the occurrence of a power outage, the time-maintaining advancing sequence of the switching mechanism will continue to run and thereby, at a renewed presence in the main power supply, the power control over the timer will again take place at the specified points in time. However, in having a timer equipped with such a running reserve, it is necessary to provide two driving mechanisms in order to facilitate the time-dependent operation of the timer selectively from either a main power supply or from a battery, which as a rule has a contrastingly lower voltage, or with quite considerably complex converting circuits for the seamlessly smooth operating transition of the driving device between different power sources which are known in the art. Moreover, it is particularly problematic in the utilization of such a power-backed running reserve, that the power storage element or battery, because of aging phenomena, will no longer possess the necessary capacity for the bridging operation. This typically occurs after a multi-year undisrupted operation utilizing the main power, while the running reserve slowly discharges, and there is a failure of the main power supply. The available power storages which come into consideration for the running reserve, especially such as rechargeable batteries are in effect subject to the quite serious disadvantage, that after a few years, as a result of age, there will be encountered an internal short-circuit condition; in effect, they would no longer be available as a bridging source. The short-circuit can even lead to the operating failure for the timer notwithstanding the available or renewedly available main power supply. In particular, at high temperatures of the surroundings, such as can also be encountered in switch boxes, the life expectancy of such power storages sinks rapidly to short residual time periods; while on the other hand, low temperatures of the surroundings lead to a considerably reduced capacity for the electrochemical power storage.

SUMMARY OF THE INVENTION

Accordingly, in recognition of these conditions, it is an object of the present invention to provide a timer which is operationally-resistive or substantially impervious against power outages, and which without the need for the relatively expensive and comparatively disruption-susceptible power storages, is adequate for the conventional assurance of providing for an operating or running reserve.

The foregoing object is inventively attained in that the timer of the type considered herein includes a nonvolatile power storage device which is programmed with preselected switching timepoints, and instead of a power storage-buffered or backed running reserve possesses only a resetting device for the actual timer time setting at the renewed availability of the main power supply.

The foregoing object is predicated on the recognition that the lead circuit, the power consumer or appliance, such as a heating installation, which is to be controlled in dependence upon the actual time, cannot be operated when the main power supply which supplies the controlling timer as well as the lead circuit does not stand available. In essence, it is adequate that the power consumer or appliance control which is oriented to the absolute time is then automatically again placed into operation in its correct time, when the main power supply again renders available the operating power. However, for this purpose the need for any conventional running reserve which would be based on the above described bridging operation from a power storage device is obviated. In the present invention, when the main power supply is once again able to provide power, the timer is corrected for its future operation to the present. This is effectuated, for example, by means of a central time transmitter over a wire utilizing remote communication or power supply lines, or more preferably by means of a radio clock. The radio clock essentially operating as a receiver and possibly display installation which is synchronized through a time telegram-radio transmitter. From the impulse telegrams or signals which are transmitted by radio, the telegram-radio transmitter decodes the momentarily set time, and with this absolute time information newly sets from the time register of an electronic timer which is to be switched forward from the power supply; for example, the wheel mechanism of a motor-driven clockwork.

Thus, the control over the power consumer is again effectuated in the correct time when the main power supply again stands available, and the actual time can again be decoded on which there is corrected the heretofore power outage-caused indication in malfunctioning in the control of the switching position, without that this necessitates the expensive and disruption-susceptible power storage for an operational bridging during the power outage.

BRIEF DESCRIPTION OF THE DRAWING

Reference may now be had to the following detailed description of an exemplary embodiment of the invention drawing the advantages and features thereof, taken in conjunction with the accompanying single figure of drawing illustrating in a single-poled block circuit diagram, a timing clock or timer which incorporates a radio clock operated by the same power supply for the time-control of an appliance or consumer which is supplied from this power supply.

DETAILED DESCRIPTION

An appliance or power consumer 11, such as a heating or illuminating installation, is to be connected to, and disconnected from the power supply 12 at specified points in time. For this purpose, the power consumer or user 11 is connected through a switching circuit 13 of a timer 14 to the power supply 12. An electro-mechanical or electronic time control installation or clock 15 is controllable through a non-volatile storage device 16 such that the switching circuit 13 is either switched on or off at specified points in time with regard to the operation of the timer 14. The term non-volatile is a term of art which is used to indicate that the particular device, whether it be an electro-mechanical device such as a time-timing dial or an electronic device such as a ROM or EEPROM, will perform its predetermined function regardless of external interruptions. In the present invention, the non-volatile storage device 16 is preprogrammed with a predetermined switching cycle. Regardless of an power outages, interruptions or surges, the non-volatile storage device 16 will contain the predetermined switching cycle. Based upon these programmed times, the time control installation 15 will open or close the swtichign circuit 13 accordingly.

The timer 14 is not provided with a running reserve for the bridging over of operationally-caused or disruption-caused temporary or transient outages of the main power supply 12. At the outage of the power supply 12, the timer 14 remains at a standstill. As a result, there is accordingly an interruption in the time-dependent control over the switching circuit 13. This interruption is of little consequence because in the absence of energy being available in the main power supply 12, the power consumer or user 11 which is dependent upon the power supply cannot be operated. The content of the non-volatile storage device 16 for the specified switching timepoints, however, remains intact due to the fact of its non-volatile construction. If a power outage occurs prior to the time-correct renewed operation of the switching control, which is the normal operation of the device which has been programmed into the non-volatile storage device 16, the switching circuit 13 is set to the open position, thereby disconnecting the power consumer 11 from the power supply 12. The switching circuit 13 is automatically set to the open position in order to avoid any uncontrolled switching cycles or, respectively, undesired heavy-load conditions at the renewed availability of the main power supply 12. If the switching circuit 13 were not set to the open position and held there upon the renewed availability of the power, the power consumer 11 might to subjected to numerous power cycles as the time control installation 15 is reset. A few minutes, subsequent to the return of the main power and the present decoded and the timer 14 is correspondingly reset, then in sequence the time-dependent specified switching conditions, which have been programmed into the non-volatile storage device 16, will be actuated. Hereby, there can be contemplated to operate further at the correct time with the previously interrupted switching program, stored in the non-volatile storage device 16 however, the operating cycles which were skipped during the interruption are caught up with offset in time in a manner for example, so as not to avoid any cooling phases utilized in the refrigeration technology. Basically, the time control of the power consumer 11 should pick up at the state where it should have been prior to the power interruption.

For example, when the power supply 12 is again placed into operation and, as a consequence, the timer 14 again commences running, there is a tendency that because of the previous operating standstill, eventually the momentary actuation of the switching 13 is no longer stored in coincidence with that which is actually specified for this point in time. In order to again synchronize the time control as rapidly as possible with the actual timing sequence, a radio clock 17 is provided as a resetting device, from which the time-control device 15 is corrected to the actual time which is received over the radio clock 17. A receiving decoder 18, which is basically a radio receiver and decoder, is connected to the main power supply 12 and the time-control device 15. The radio clock 17 need not operate independently, but can also be powered from the main power supply 12. This, as stated previously, is because as long as the main power supply 12 has failed the, power consumer or user 11 cannot be operated, and in effect no switching cycles need to be implemented.

When the power supply 12 is again available, normal operating conditions, the radio clock 17 will receive time telegrams or signals, through the receiving decoder 18, the absolute time information for implementing the correction of the time-control device 15. The receiving decoder 18 is utilized to reset the time-control device or clock 15 to the present time of day. The receiving decoder 18 accomplishes this for example by temporarily providing more power to the clock 15 thereby forcing it to move ahead in time just as in every ordinary radio controlled consumer clock. If the clock 15 is an electro-mechanical timer, then it is reset by accelerated operation of the drive mechanism of the clock. It is important to recall however, that during this correction time, the switching circuit 13 is open. The clock 15 and the non-volatile storage device 16 control only the switching circuit 13 based upon a predetermined program or sequence. The switching circuit 13 is only a bridge between the power supply 12 and the power user 11.

Power users or consumers 11 are available which evaluate time-dependent power supply-control functions, especially through their timer control. Therefore, malfunctions caused by fluctuations in the periodicity of the voltage in the main power supply 12 cannot be completely precluded, and thus the time information which is obtained for the timer 14 from a vacillating power supply 12 can at least temporarily not exactly coincide with the official time which is determined by means of the radio clock 17. In order to avoid disturbances due to these time differences an activating control circuit 19 is utilized. The activating control circuit 19, which responds to the renewed operation of the previously switched-off power supply 12, will place the radio clock 17 into temporary operation, and thereafter to again alone operate the timer 14 from the power supply 12. Basically, to avoid fluctuations in time caused by fluctuations in the supply voltage, the timing of the power consumer 11 is controlled by the radio clock 17. However, it can be contemplated that the activating control circuit 19 be designed such that at greater intervals the momentary time setting of the timer 14 is tested and possibly is to be corrected, when as a result of operating malfunctions, without any actual power outage time offsets should have been encountered due to the actuation of the switching circuit 13.

At the input of the control circuit 19, there is a differential positive signal which appears when the power is returned after a power outage on the power supply line 12. The control circuit 19 thus only reacts to the reappearance of the voltage in the power supply 12. It reacts with the output of an actuating signal for the radio clock 17 which receives from a long wave transmitter a binary coded telegram, whose content is the actual real specified point in time. This coded real time information is converted in the decoding circuit 18 (as is known in every commercial radio clock) into a time information signal which is transmitted to the time control-installation 15 of the timer 14. This time control installation 15 can be an electro-mechanical or electronic clock as stated above and which through the assumption of the decoded actual time information from the momentary erroneous position (in as much as the operation with the outage of the power supply 12 was interrupted) is corrected to the actual momentarily specified point in time. This correction is effected, as is usual for every ordinary radio controlled consumer clock, and in the electromechanical instance through accelerated operation of the drive, until the display again "shows correct". Naturally, for a timer 14, the time need not be indicated by indicators or numerals, it is adequate that the correction of the time setting is effected internally after an interruption of the operation due to an outage of the power 12 has been ended.

What is claimed is:

1. A continuous timer which is resistive to a power outage, comprising:

an alterable non-volatile storage device for storing specifiable switching time points and controlling said continuous timer to connect and disconnect a power consumer from a power supply in accordance with said specifiable switching time points wherein during a power outage said continuous timer is deactivated and said specifiable switching time points remain stored in said alterable non-volatile storage device; and resetting means for setting the continuous timer to the actual time at a renewed availability of the power supply and prior to reactivating said timer, said timer being operable in accordance with said specifiable switching time points after being reactivated.

2. A timer as claimed in claim 1, wherein said resetting means comprises a radio clock.

3. A timer as claimed in claim 1, wherein said resetting means is operable through an activating control circuit which is temporarily effective upon the renewed availability of the power supply.

4. A timer as claimed in claim 1, wherein at the renewed availability of the power supply, a specified switching sequence program stored in said non-volatile storage device is operated in the correct time to avoid unnecessary switching cycles.

5. A timer as claimed in claim 4, wherein at the renewed availability of the power supply, the timer is accelerated to compensate for the corresponding offset in time such that the switching sequence program will resume at a point where it would have been had there been no power interruption.

* * * * *

UNITED STATES PATENT AND TRADEMARK OFFICE

CERTIFICATE OF CORRECTION

PATENT NO. : 5,260,916
DATED : November 9, 1993
INVENTOR(S) : Bernard Schott

It is certified that error appears in the above-indentified patent and that said Letters Patent is hereby corrected as shown below:

On the Title Page, Section [30]: "[FR] France" should read --[DE] Germany--

Column 3, line 32: "an" should read --any--

Column 3, line 36: "swtichign" should read --switching--

Column 3, line 66: after "present" insert --time--

Signed and Sealed this
Seventh Day of February, 1995

Bruce Lehman

*Attest:*

BRUCE LEHMAN

*Attesting Officer*

*Commissioner of Patents and Trademarks*